United States Patent [19]

Hall, Jr.

[11] 4,325,673

[45] Apr. 20, 1982

[54] VARIABLE VANE SEAL

[75] Inventor: Beuford C. Hall, Jr., Clermont, Ind.

[73] Assignee: General Motors Corporation, Detroit, Mich.

[21] Appl. No.: 129,042

[22] Filed: Mar. 10, 1980

[51] Int. Cl.[3] ..... F04D 29/08

[52] U.S. Cl. ..... 415/113; 415/164; 415/211

[58] Field of Search ..... 415/110, 113, 115, 116, 415/167, 164, 165, 207, 211

[56] References Cited

U.S. PATENT DOCUMENTS 3,963,369 6/1976 Balje ..... 415/148

3,992,128 11/1976 Lunsford ..... 415/161

FOREIGN PATENT DOCUMENTS 2416165 10/1975 Fed. Rep. of Germany ..... 415/211

2840336 3/1979 Fed. Rep. of Germany .

*Primary Examiner*—L. J. Casaregola

*Assistant Examiner*—J. A. Simenauer

*Attorney, Agent, or Firm*—J. C. Evans

[57] ABSTRACT

A diffuser for a centrifugal compressor has an annular array of vanes which is movable to vary the configuration of the diffusing passages between the vanes. Each vane includes suction and pressure surfaces joined at an inlet apex and divergent therefrom to form a wedge-shaped control surface between fixed, spaced parallel side walls of the diffuser and pivoted about the apex for varying flow area through the diffuser. Each vane has an elastomeric inner portion which is selectively inflatable to expand to either side of said wedge-shaped control surface to sealingly engage the spaced parallel side walls to seal against gas flow between the pressure surface and the suction surface on each of the vanes.

4 Claims, 4 Drawing Figures

VARIABLE VANE SEAL

This invention relates to diffusers for compressors including centrifugal or radial flow compressors and is directed to diffuser structures of variable configuration adapted to provide efficient diffusion at varying rates of flow and more particularly to such systems with means to prevent leakage of gas flow around vanes of the diffuser.

The principal objects of this invention are to provide a diffuser adaptable to varying rates of flow, to provide a diffuser in which the settings of the vanes are variable and including means to seal sides of the vanes to prevent vane leakage so as to achieve the optimum diffuser exit-to-inlet area ratio for varying flow conditions by changing the direction of flow and divergence of the passages. More particularly, it is an object of the invention to provide such a diffuser of the radial flow type wherein the seal means is an elastomeric member that seals against diffuser side walls when a diffuser vane is in an adjusted position. A further object is to provide a variable diffuser with a vane seal of simple and reliable structure and of an improved mode of actuation.

The nature of the invention and its advantages will be apparent to those skilled in the art from the succeeding detailed description of the preferred embodiment of the invention and the accompanying drawings thereof.

Figure 1:
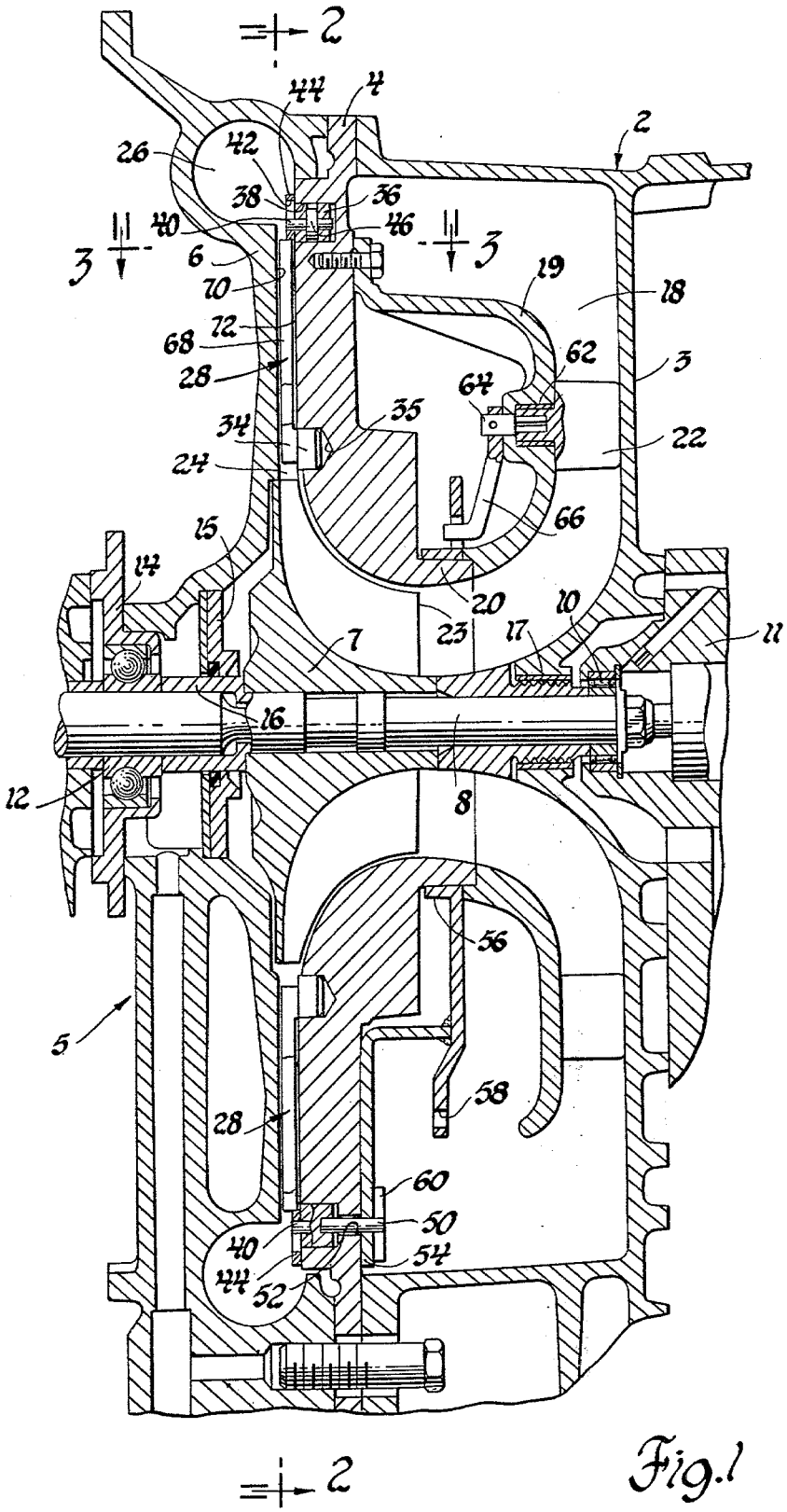
FIG. 1 is a longitudinal sectional view of a centrifugal compressor taken in a plane containing the axis of rotation of the compressor rotor.

FIG. 1 illustrates a compressor embodying the invention as it might appear installed in an automotive gas turbine engine. Details of the engine are immaterial to the present invention but, by way of background, it may be pointed out that engines of this sort are described in U.S. Pat. Nos. as follows: Collman et al 3,077,074, Feb. 12, 1963, and Bell 3,490,746, Jan. 20, 1970.

Referring first to FIG. 1, the engine housing or frame 2 may include a plate 3, a diffuser front wall 4, and diffuser rear wall 6. These are generally annular bodies bolted together at peripheral flanges. The radial flow compressor 5 includes a rotor or impeller 7 fixed to a shaft 8. This shaft is supported in a bearing 10 mounted in a housing 11 bolted to the plate 3. It is supported in a thrust bearing 12 mounted in a support 14 fixed to the rear wall 6. A rotor oil seal 15 is supported between wall 6 and sleeve 16 to seal the rear wall of rotor 7. A shaft oil seal 17 on plate 3 seals shaft 8.

Air is admitted through a suitable intake into an intake chamber 18 between the plate 3 and wall 4. This chamber is bounded on its inner side by an air inlet outer shroud ring 19. The outer margin of this ring is bolted and dowelled to the wall 4 and the inner margin mates with forwardly extending flange 20 of wall 4. Flange 20 is the forward or inner end of the portion of wall 4 which defines a fixed shroud for the compressor rotor 7. Air flows from the chamber 18 radially inward through a row of adjustable setting inlet guide vanes 22 into the inlet eye 23 of the impeller. The impeller discharges the air into a diffuser 24 extending radially outward from the periphery of the impeller between walls 4 and 6 to a scroll or collection chamber 26 from which the air is delivered through a regenerator to the combustion chamber of the engine.

The significant subject matter of the present invention lies principally in the variable vanes 28 which are shown most clearly in the remaining figures of the drawings.

Each variable vane 28 includes divergent walls 30, 32 joined at an apex or thin leading edge 33 and the leading portin of the vane is brazed, welded, or otherwise fixed to a cylindrical plug 34 which is rotatably fitted into a bore or recess 35 in the wall 4. The vane 28 thus swings about the axis of plug 34 when it is moved by an actuating ring 36 which is mounted in an annular recess 38 in the wall 4 for rotation about the axis of shaft 8. Ring 36 has axially extending pins 40, one for each of the vanes 28. Pin 40 coacts with ramp means defined by the walls of a slot 42 and actuator tab 44 on each vane 28. The walls of this slot provide a cam and follower connection from the ring 36 and pins 40 to the vanes 28. Rotation of the ring 36 causes each vane 28 to adopt a greater angle to the radial direction and also swings the vanes 28 closer together, reducing the area of the discharge path from the compressor.

The actuating ring may be supported for free movement in the recess 38 by circumferentially spaced rollers 46 rolling on the inner surface of recess 38. It may be located axially by rollers 46 rotatable about radial axes and engaging in circumferential slots extending part way around the outer periphery of the ring 36. These details are immaterial to the invention, however, as are the means for rotating the ring 36.

The ring is rotated by two drive pins 50 (FIG. 1), only one of which is illustrated, which are approximately diametrically spaced and extend forwardly from the ring 36 through slots 52 in the front wall 4. The pins 50 are moved by arms 54 extending from an actuating ring 56 journaled for rotation on the forward portion 20 of wall 4. This ring may be rotated by a suitable actuator connected to an eye 58 on an arm extending from ring 56. Movement of the ring 56 and ring 36 may be limited by a stop plate 60.

Ring 56 also is connected to actuate the inlet guide vanes 22 which are journaled in bearings 62 in the ring 19. The hub or shaft of each vane is fixed to a shaft 64, in turn fixed to an arm 66 which engages within a slot in the ring 56 for rotation of the inlet vanes 22.

It will be seen from the foregoing that by connection of any suitably controlled actuator to the eye 58 on ring 56 to rotate the ring the vanes 22 and 28 may be rotated about their mounts and the vanes 28 may be spread to vary the air flow capacity of the compressor. The apparatus for control of the movement of such an actuator is immaterial to our invention and therefore will not be described.

It should be apparent that the principles of the invention as will be described can be applied to diffusers of other types, such as axial flow diffusers, with suitable modification of structure. In an axial flow diffuser the vanes would extend radially between outer and inner walls and rotate about radiating axes. Rotation of an actuating ring circumferentially of the diffuser would correspond to circumferential movement in FIGS. 1 to 3 if the setting of the vanes is appropriate for such movement. Also, an actuating ring could move longitudinally of an axial flow diffuser.

Figure 3:
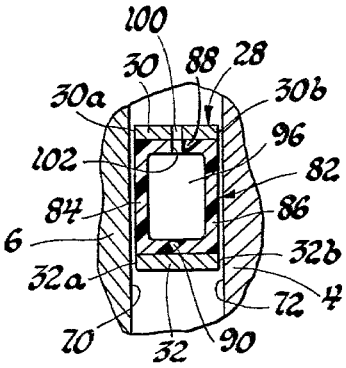
FIG. 3 is an enlarged fragmentary cross-sectional view taken along the line 3—3 of FIG. 1 looking in the direction of the arrows.

More particularly, in the illustrated embodiment of the invention, the diffuser 24 and each of the vanes 28 are located in a diffuser space 68 between spaced radial diffuser walls 70, 72 as shown in FIG. 1 defining a diffuser entrance 74 and diffuser exit 76. In such arrangements, one problem is leakage between a pressure surface 78 to a suction surface 80 on each of the vanes 28. Such gas bypass can affect otherwise desirable performance and operating characteristics which can be achieved in diffusers for centrifugal compressors having channel type diffusers with variably positioned articulated vanes therein. In such arrangements, the vanes are typically loosely confined between the parallel side walls 70 and 72. And, as seen in FIG. 3, in order to maintain sufficient clearance between the side walls 70, 72, in the illustrated arrangement each of the divergent walls 30, 32 of the individual vanes 28 has side edges 30*a*, 30*b* and 32*a*, 32*b* located in spaced relationship to the side walls 70, 72 through a clearance space necessary to permit ready sliding movement of the vane without excessive force acting on the aforesaid drive mechanism. Accordingly, because of static pressure variations that exist between the suction and pressure surfaces of each vane, which is a function of local flow velocity considerations, there can be gas leakage around the vane that will produce aerodynamic inefficiencies.

Figure 2:
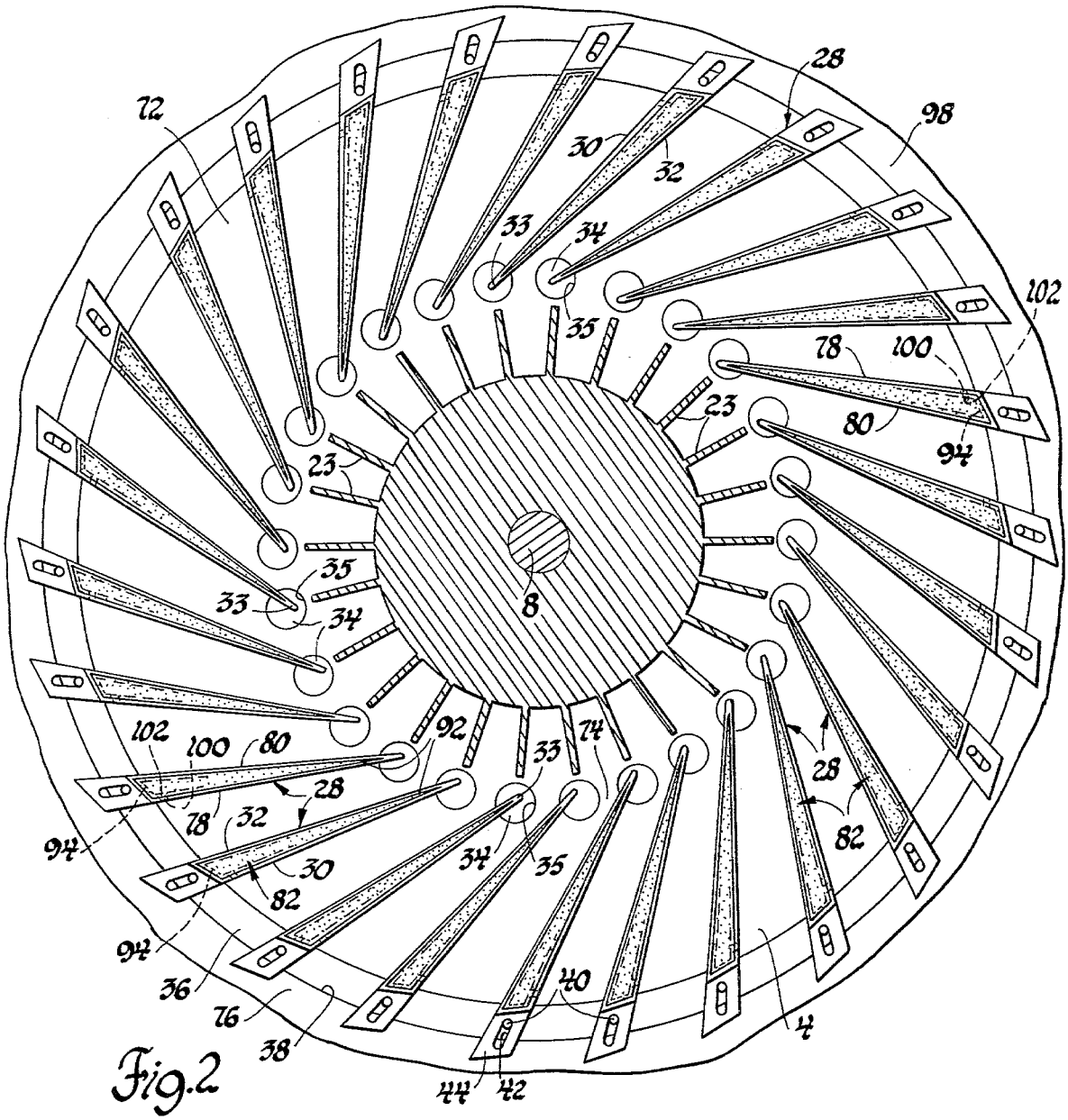
FIG. 2 is a transverse sectional view taken on the plane indicated by the line 2—2 in FIG. 1 showing an adjusted flow configuration of the diffuser vanes.
Figure 4:
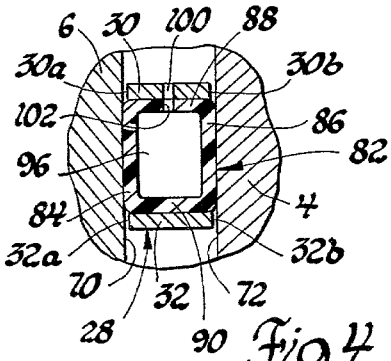
FIG. 4 is an enlarged sectional view like FIG. 3 showing an elastomeric seal member in an expanded, side wall seal engagement position.

In accordance with the present invention, such leakage is controlled by an inflatable elastomeric seal member 82 which more particularly includes spaced side walls 84, 86, each of wedge-shaped configuration and congruent with the inside perimeter of walls 30, 32 as seen in FIG. 2. The walls 84, 86 are located in spaced relationship to the radial side walls 70, 72 of the diffuser when the engine is inoperative. When the engine is started, the chamber 96 is inflated to cause the side walls to expand into contact with walls 70, 72 without imposition of substantial actuating forces on the mechanism for adjusting the array of individual vanes 28 into the various adjusted positions about the pivot plugs 34. More particularly, each of the inflatable seal members 82 further includes a pair of divergent wall segments 88, 90 thereon that are in engagement with the inner surface of the divergent vane walls 30, 32 as best shown in FIGS. 2 and 3. Together the side walls 84, 86 and divergent walls 88, 90 are joined at an apex 92 and closed by an outer end wall 94 to define an inflatable chamber 96 within the elastomeric seal member that is communicated with a region at the diffuser exit of low velocity and higher static pressure indicated by the reference numeral 98 in FIG. 2. At the high pressure region 98, each of the divergent walls 30 at the pressure surface 78 has an aperture 100 formed therein which communicates with an aperture 102 in the wall 88 so that the chamber 96 of the elastomeric seal member 82 will be pressurized in accordance with the pressure level at the exit of the diffuser. Where higher static pressure exists, greater leakage can occur between the pressure and suction surfaces 78, 80 of each of the vanes, the pressurizable chamber 96 formed within each of the elastomeric seal members 82 is inflated to cause the side walls 84, 86 thereof to expand into the position shown in FIG. 4, thereby to close the clearance space otherwise existing between each of the adjusted vanes 28 and the parallel, radially extending side walls 70, 72 shwn in the illustrated embodiment of the present invention. The amount of flex in the elastomeric composition of each of the seal members 82 can be adjusted along with the size of the apertures 100, 102 to control the force exerted by the seal member 82 on the side walls. Furthermore, dry film surface treatments and coatings can be applied to the outer surface of each of the walls 84, 86 to reduce frictional forces between the elastomeric material and the vane as required to reposition the vanes between the various control positions.

While the embodiments of the present invention, as herein disclosed, constitute a preferred form, it is to be understood that other forms might be adopted.

The embodiments of the invention in which an exclusive property or privilege is claimed are defined as follows:

1. In a variable configuration diffuser for a gas compressor having means for forming spaced diffuser walls defining a diffuser region having an entrance and an exit for diffusion of flow from a compressor rotor to an outlet and an annular cascade of variable vanes with each of the vanes extending between said walls and including a leading edge adjacent the entrance to the diffuser region and a trailing portion adjacent the exit therefrom and means for positioning each of said vanes in a variable relationship with respect to said diffuser region the improvement comprising: means forming a space in each of said vanes having side openings therefrom, an inflatable member located within said space, said inflatable member having spaced walls located in spaced relationship with respect to the inner surface of the diffuser walls to reduce vane drag during adjustment of said vanes with respect to the diffuser region to control the ratio of flow area at the diffuser entrance to the flow area at the diffuser exit, and means for inflating said inflatable member to cause the spaced walls thereof to be biased into sealed engagement with the spaced diffuser walls within the diffuser region thereby to prevent leakage from the pressure-to-suction side of each of the vanes.

2. In a variable configuration diffuser for a gas compressor having means for forming spaced diffuser walls defining a diffuser region having an entrance and an exit for diffusion of flow from a compressor rotor to an outlet and an annular cascade of variable vanes with each of the vanes extending between said walls and including a leading edge adjacent the entrance to the diffuser region and a trailing portion adjacent the exit therefrom and means for positioning each of said vanes in a variable relationship with respect to said diffuser region the improvement comprising: means forming a space in each of said vanes having side openings therefrom, an inflatable member located within said space, said inflatable member having spaced walls located in spaced relationship with respect to the inner surface of the diffuser walls to reduce vane drag during adjustment of said vanes with respect to the diffuser region to control the ratio of flow area at the diffuser entrance to the flow area at the diffuser exit, and means for inflating said inflatable member to cause the spaced walls thereof to be biased into sealed engagement with the spaced diffuser walls within the diffuser region thereby to prevent leakage from the pressure-to-suction side of each of the vanes, said means for inflating said inflatable member including an aperture formed in each of said vanes at the trailing portion thereof, means forming a pressurizable chamber in said inflatable member in communication with said aperture to direct diffused pressure from the diffuser exit so as to cause the spaced walls of the inflatable member to be pressure biased against the diffuser walls.

3. In a variable configuration diffuser for a radial gas compressor having means for forming spaced radial walls defining an annular space having an entrance and an exit for diffusion of flow from a compressor rotor to an outlet and an annular cascade of variable vanes with each of said vanes extending between said walls and including a leading edge adjacent the entrance to the annular space and a trailing portion adjacent the exit therefrom and means for positioning each of said vanes in a variable relationship with respect to said annular space, the improvement comprising: a wedge opening in each of said vanes having generally tapered side openings therefrom, an inflatable member located within said space, said inflatable member having spaced walls located in spaced relationship with respect to the inner surface of the spaced radial walls to reduce vane drag during adjustment of said vanes with respect to the annular space for controlling the ratio of flow area at a diffuser inlet flow region to a diffuser exit flow region, and means for selectively inflating said inflatable member to cause the side walls thereof to be biased into sealed engagement with the spaced radial walls within the annular space, thereby to close the clearance space between the vanes and the spaced radial walls to prevent leakage from the suction-to-pressure side of each of the vanes.

4. In a variable configuration diffuser for a radial gas compressor having means for forming spaced radial walls defining an annular space having an entrance and an exit for diffusion of flow from a compressor rotor to an outlet and an annular cascade of variable vanes with each of said vanes extending between said walls and including a leading edge adjacent the entrance to the annular space and a trailing portion adjacent the exit therefrom and means for positioning each of said vanes in a variable relationship with respect to said annular space, the improvement comprising: a wedge opening in each of said vanes having generally tapered side openings therefrom, an inflatable member located within said space, said inflatable member having spaced walls located in spaced relationship with respect to the inner surface of the spaced radial walls to reduce vane drag during adjustment of said vanes with respect to the annular space for controlling the ratio of flow area at a diffuser inlet flow region to a diffuser exit flow region, and means for selectively inflating said inflatable member to cause the side walls thereof to be biased into sealed engagement with the spaced radial walls within the annular space, thereby to close the clearance space between the vanes and the spaced radial walls to prevent leakage from the suction-to-pressure side of each of the vanes, said means for inflating said inflatable member including an aperture formed in each of said vanes at the trailing portion thereof, means forming a pressurizable chamber in said inflatable member in communication with said aperture to direct diffused pressure from the exit of the annular space so as to cause the spaced walls of the inflatable member to be pressure biased against the spaced radial walls.

* * * * *